US011952765B2

(12) United States Patent
Han

(10) Patent No.: US 11,952,765 B2
(45) Date of Patent: Apr. 9, 2024

(54) WATER REUSE DEVICE FOR REUSING WATER USED IN THE BATHROOM AS WATER FOR TOILETS WITH FLUSH VALVES

(71) Applicant: Kab Young Han, Seoul (KR)

(72) Inventor: Kab Young Han, Seoul (KR)

( * ) Notice: Subject to any disclaimer, the term of this patent is extended or adjusted under 35 U.S.C. 154(b) by 27 days.

(21) Appl. No.: 18/071,803

(22) Filed: Nov. 30, 2022

(65) Prior Publication Data

US 2023/0183962 A1 Jun. 15, 2023

(30) Foreign Application Priority Data

Dec. 14, 2021 (KR) ..... 10-2021-0178529

(51) Int. Cl.
*E03D 5/00* (2006.01)
*E03D 5/01* (2006.01)

(52) U.S. Cl.
CPC ..... *E03D 5/003* (2013.01); *E03D 5/01* (2013.01)

(58) Field of Classification Search
CPC ..... E03D 5/003
See application file for complete search history.

(56) References Cited

U.S. PATENT DOCUMENTS 7,118,677 B2 * 10/2006 Hoffjann ..... B64D 11/02 210/744

FOREIGN PATENT DOCUMENTS

KR 10-0929478 B1 12/2009
KR 10-2016-0107569 A 9/2016

* cited by examiner

*Primary Examiner* — Christine J Skubinna

(57) ABSTRACT

A water reuse device for reusing waste water discharged from a bathroom or a kitchen as toilet flushing water, including: a water collecting tank (10); a storage tank (20) receiving the used water stored in the water collecting tank (10) and having a water level sensor (21); a toilet water tank (32) located at a lower level than the storage tank (20) and having a first water level sensor (36) and a second water level sensor (35); a first pipe (22) connecting the storage tank (20) and the toilet water tank (32); a first solenoid valve (40) installed in the first pipe (22); a second pump (38) installed in the toilet water tank (32); a backflow prevention valve (34) provided between the second pipe (33-2) and the third pipe (33-3); and a water shutoff valve (41) provided between a water supply pipe (31) and the water pressure control valve (41-1).

1 Claim, 3 Drawing Sheets

WATER REUSE DEVICE FOR REUSING WATER USED IN THE BATHROOM AS WATER FOR TOILETS WITH FLUSH VALVES

CROSS-REFERENCE TO RELATED APPLICATION

This application claims priority under 35 U.S.C § 119 to Korean Patent Application No. 10-2021-0178529, filed in the Korean Intellectual Property Office on Dec. 14, 2021, the entire contents of which are hereby incorporated by reference.

TECHNICAL FIELD

The present disclosure relates to a device for recovering the water (hereinafter, also referred to as "tap water") used in a bathroom with a wash basin and reusing the used water for flushing a toilet bowl attached with a washing valve (hereinafter, "toilet bowl"), and more particularly, to a device for collecting the relatively clean used shower water or handwash water to store in a storage tank and reusing the stored used water for flushing; the toilet bowl, thereby reducing environmental pollution as well as effectively saving water.

BACKGROUND ART

Generally, a shower or wash basin provided in a shower room or bathroom or a sink provided in a kitchen is used to take a shower, wash hands or face, or use water in the kitchen. A water tee and a ball valve can be attached to the bottom of the wash basin to discharge the used water to the outside through a sewage pipe by opening the ball valve when the used water is heavily contaminated. Separate holes can also be provided at the bottom of the sink such that contaminated water is discharged therethrough to a sewage pipe as in the general cases, and relatively less contaminated used water from fruit cleaning can drain through a discharge hole connected to a water collecting tank for storage that can be additionally installed, while the original sewage pipe is closed with a lid. A strainer can be installed at the bottom of a water collecting port of the water collecting tank to prevent a foreign substance such as hair or solid organic matter from flowing from the wash basin or the sink into the water collecting tank in the process of collecting the used water.

In this way; a large amount of water is used for showers, face or hand washing, kitchens, and the like, but as is known, the water is purified river water or rainwater that is transported to each home or office through the water line, and it requires a lot of equipment and costs in the purification treatment and transport processes.

Therefore, fees set per liter are collected for the water so that the protection of the water source and stable water quality may be ensured through taxes.

However, since water is produced using river water or rainwater, a shortage of water resources poses a serious difficulty in the operation of the water supply. In addition, once used for showering or face washing, the water is classified as sewage which is a pollutant, and the sewage also needs to go through various purification processes through sewage treatment facilities, thereby incurring considerable costs and environmental pollution.

It is generally known that a shower consumes approximately 40 to 60 liters of water, face washing consumes 10 to 20 liters, and hand washing consumes 2 to 4 liters of water.

Moreover, what consumes the largest amount of water, other than the water used for showers or face washing, may be flush toilets. A typical flush toilet has a toilet tank of approximately 6 to 13 liters so that 6 to 13 liters of water is consumed each time the toilet is used. A family of four uses the toilet around 10 times a day on average such that a considerable amount of water is consumed by the toilet for this reason.

The use of water tends to increase significantly due to frequent showering, face washing, and use of toilets, and with this, more equipment and facilities are provided to stably supply water. Further, various systems, equipment, and mechanisms are being developed to reduce the use of water as described above, and the development of water-saving toilets is being studied more actively.

As more water is thrown away down the sewage as the use of water increases as described above, the desire to reuse the water also increases.

Therefore, there is an urgent need for a more fundamental water-saving method, rather than a method of institutional, or physical restriction on the water whose usage gradually increases.

SUMMARY OF THE INVENTION

An object of the present disclosure is to provide a water reuse device, in which water from a shower, wash basin, or kitchen is stored in a water collecting tank buried under or exposed on an indoor floor and the water reuse device includes a water storing tank connected to the water collecting tank to store the used water, the used water in the storing tank is connected to a toilet water tank through a discharge pipe, the used water is stored in the storage tank through a transport pipe connected to a function of water level sensor inside the water collecting tank and a pump, and by the function of the water level sensor inside the storage tank and the operation of a solenoid valve, the device reuses the used water in the storage tank as toilet water for a toilet bowl attached with a toilet water tank.

A water reuse device of the present disclosure to solve the problems described above includes a water collecting tank (10) for collecting used water; a storage tank (20) receiving the used water stored in the water collecting tank (10) and having a water level sensor (21); a toilet water tank (32) located at a lower level than the storage tank (20) and having a first water level sensor (36) and a second water level sensor (35), in which the first water level sensor (36) senses whether the reused water reaches a given full water level in the toilet water tank (32), in which the second water level sensor (35) senses whether the reused water reaches a given depletion water level in the toilet water tank (32); a first pipe (22) connecting the storage tank (20) and the toilet water tank (32); a first pump (23) provided in the storage tank (20) and supplying the used water in the storage tank (20) to the toilet water tank (32) through the first pipe (22); a user detection sensor (37) sensing whether there is a user using a toilet bowl (30); a first solenoid valve (40) sensor installed in the first pipe (22), in which the first solenoid valve (40) turns on or shuts off the used water supplied from the storage tank (20) to the toilet water tank (32); a second pump (38) installed in the toilet water tank (32) and communicating with a second pipe (33-2), n which the second pipe (33-2) connects a washing valve piston (33-1) and a water pressure control valve (41-1) with each other; a third pipe (33-3) connecting the toilet water tank (32) and the second pipe (33-2) with each other; a backflow prevention valve (34) provided between the second pipe (33-2) and the third pipe (33-3); and a water shutoff valve (41) provided between a water supply pipe (31) and the water pressure control valve (41-1), in which the water supply pipe (31) supplies water from a water supply pipe (11) to the toilet howl (30) through the second pipe (33-2), in which, when the second pump (38) turns on when (i) the toilet water tank (32) is in full, and (ii) the user detection sensor (37) senses the user using the toilet bowl (30), in which the used water in the toilet water tank (32) is discharged to the toilet howl (30) when a water flushing handle (33) is pressed, in which, when the used water in the toilet water tank (32) detected by the second water level sensor (35) is at a first given depletion level, the second pump (38) turns off, and the first solenoid valve (40) is opened to turn on the first pump (23) and supply the used water from the storage tank (20) to the toilet water tank (32), in which, when the used water in the toilet water tank (32) detected by the first water level sensor (36) is at a first given frill level, the first pump (23) turns off, and the first solenoid valve (40) is shut off, in which, when (a) the used water in the toilet water tank (32) is detected at the depletion level using the second water level sensor (35) and (b) water level in the storage tank (20) detected by the water level sensor (21) is at a second given depletion level, (i) the second pump (38) turns off even when the user detection sensor (37) detects the user who utilizes the toilet bowl (30), (ii) the water shutoff valve (41) remains opened, (iii) water supplied from outside through the water supply pipe (31) is discharged to the toilet bowl (30), and (iv) the backflow prevention valve (34) prevents the water supplied from outside from backflowing the toilet water tank (32).

in which a drain pipe (57) is provided in the toilet water tank (32) and prevents the used water from overflowing over the toilet water tank (32) due to a malfunction of the first pump (23), in which an upper end of the drain pipe (57) is located at a higher level than the first water level sensor (36), and in which a lower end of the drain pipe (57) is connected to a fourth pipe (39) and discharges the used water overflowing from the toilet water tank (32) to the toilet bowl (32), in which the fourth pipe (39) is provided between the piston (33-1) and the toilet bowl (30).

The present disclosure recovers relatively less contaminated used water from showering and face and hand washing and reuses the recovered used water for flushing a toilet bowl, thereby greatly reducing environmental pollution as well as earning economic gains through reasonable water saving.

BRIEF DESCRIPTION OF DRAWINGS

The above and other objects, features and advantages of the present disclosure will be described with reference to the accompanying drawings described below, where similar reference numerals indicate similar elements, but not limited thereto, in which.

DETAILED DESCRIPTION

Figure 1:
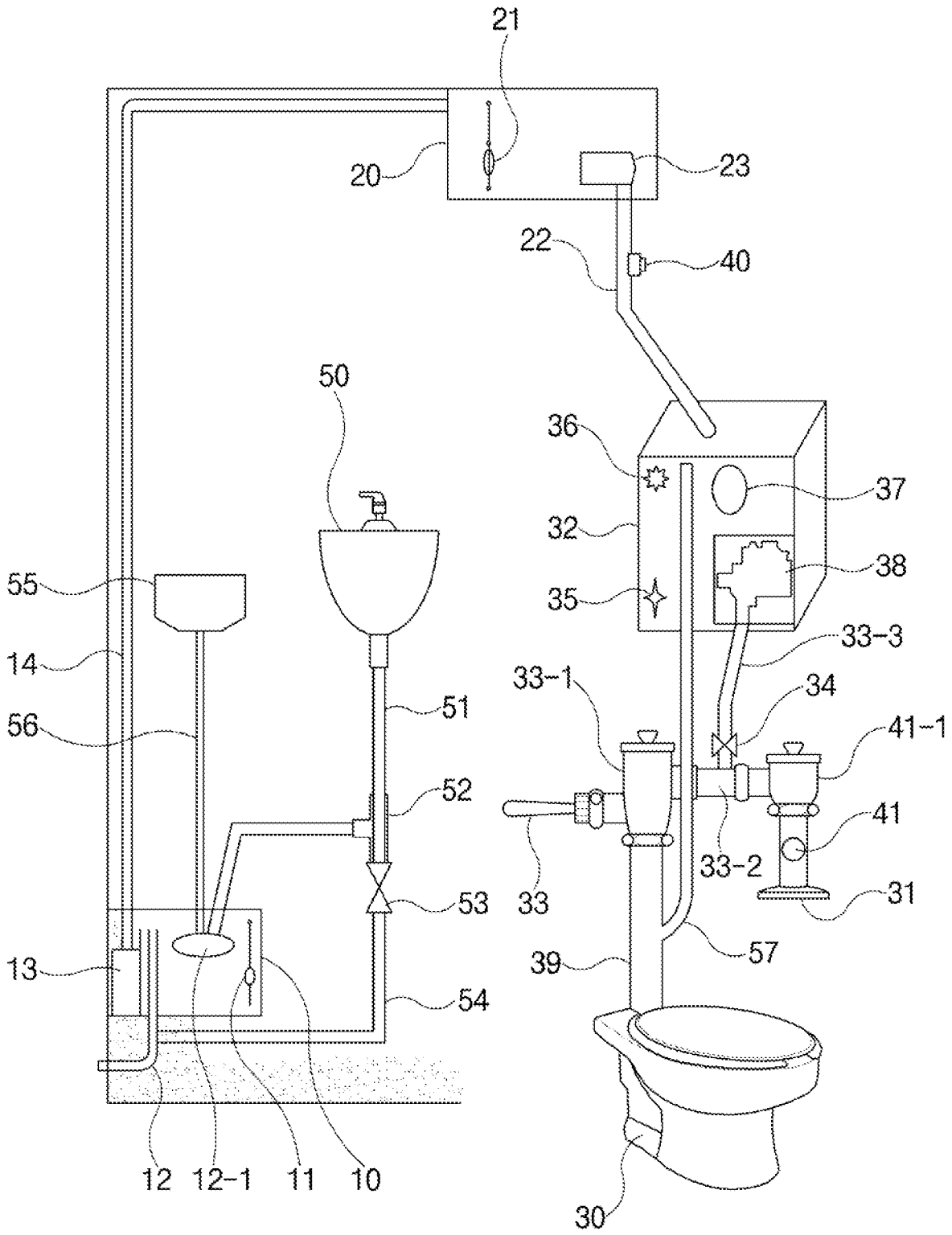
FIG. 1 shows an overall configuration of a water reuse device for reusing used water according to the present disclosure.
Figure 2:
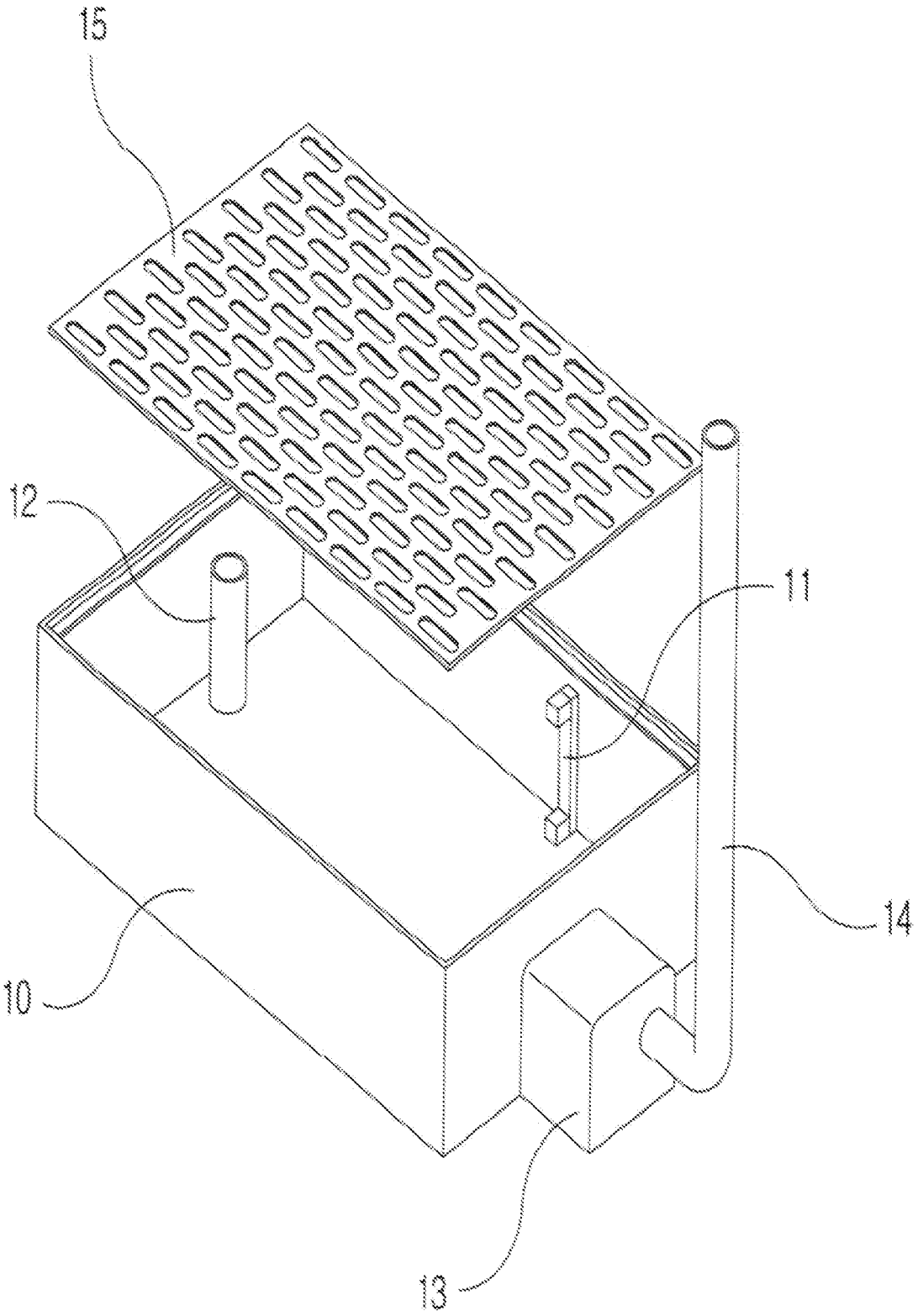
FIG. 2 is a detailed view of a water collecting tank (10) of a water collecting device according to the present disclosure.
Figure 3:
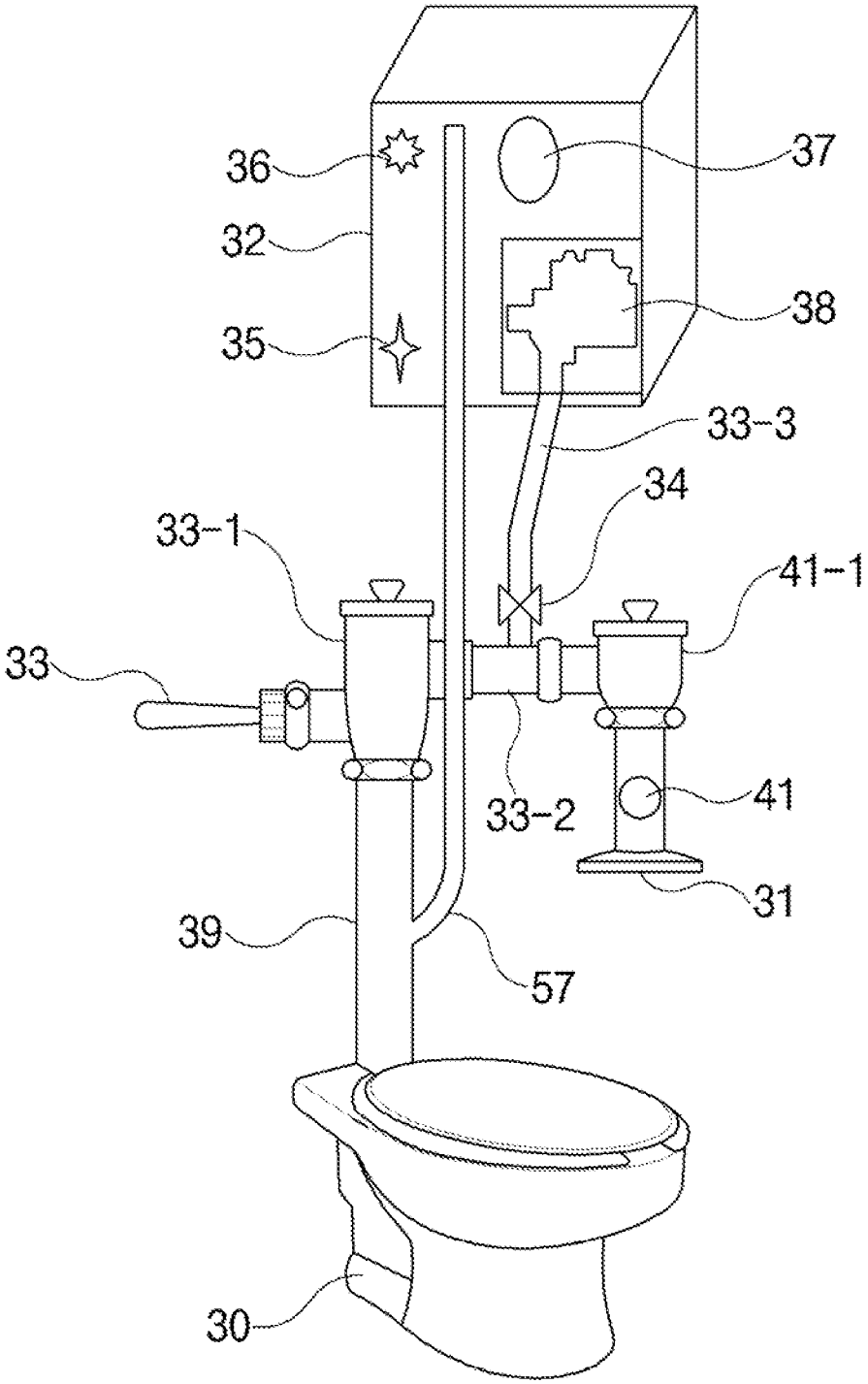
FIG. 3 is an enlarged view showing transport process from a toilet water tank (32) for reusing the used water to a toilet howl (30) through a toilet bowl washing valve according to the present disclosure.

The terms and words used in the present disclosure and claims should not be construed as limited to ordinary car dictionary meanings, but should be interpreted as the meaning and concept in accordance with the principle that the inventor can appropriately define the concept of the term in order to explain the inventive concept in the best way as possible.

According to the present disclosure, the device includes a water collecting tank (10) buried under or exposed on an indoor floor of a bathroom and the like, a storage tank (20) receiving used water from the water collecting tank (10) and storing the same, a toilet water tank (32) receiving the used water from the storage tank (20), and a toilet bowl (30) having a toilet washing valve attached thereto.

The water collecting tank (10) serves as a reservoir for effectively recovering the used water from a shower, wash basin, kitchen, and the like and includes a water level sensor (11), a drain pipe (12), and a strainer (12-1). The water level sensor (11) is configured to sense the level of the used water in the water collecting tank (10), and various types of generalized water level sensors such as a float type water level sensor, a non-contact level sensor, and an ultrasonic level sensor may apply. In addition, when the amount of used water recovered in the water collecting tank (10) increases rapidly, the drain pipe (12) serves to automatically discharge the excess used water overflowing over the storage tank (20) through a sewage line. The leading end, that is, the upper end of the drain pipe (12) is located at a slightly higher level than the water level sensor (11) so that the used water flowing into the water collecting tank (10) may be stably recovered and stored, while overflowing excess used water is rapidly and effectively discharged.

The storage tank (20) may be fixedly installed on the ceiling of a bathroom or washroom or may be made to stand vertically or lie horizontally on a pedestal if space allows. A water level sensor (21) may be mounted in the storage tank (20), and a first pump (23) may be installed in case water supply to several toilets is simultaneously required as in a public toilet. In particular, fixedly installing the storage tank (20) on the ceiling not only serves the purpose of effectively installing the storage tank (20) in a small space like a bathroom or shower room, but also allows the storage tank (20) to be fixed higher than the toilet water tank (32) such that the difference in water pressure therebetween facilitates the unforced flow of the used water in the storage tank (20) to the toilet water tank (32).

At this time, the collecting tank (10) and the storage tank (20) are connected to each other through a separate fifth pipe (14), and a third pump (13) is mounted to the fifth pipe (14) such that when the third pump (13) is driven, it is possible to forcibly transport the used water in the water collecting tank (10) at a lower position to the storage tank (20) at a higher position.

In addition, the water collecting tank (10) may have a perforated metal sheet (15) coupled to an upper surface of the water collecting tank (10) for more effective recovery of the used water from the shower, and when the water collecting tank (10) is buried with the perforated metal sheet (15) being exposed on the floor of the room, the used water from the shower can be automatically collected through the perforated metal sheet (15), which is more effective.

A second pump (38) for draining toilet water is installed in the toilet water tank (32), and a first solenoid valve (40) is installed at the end of a first pipe (22) connected to the storage tank (20) and the toilet water tank (32). A first water level sensor (36) is installed in the upper portion of the toilet water tank (32) to check whether the water is full, and a second water level sensor (35) is installed in the lower portion of the toilet water tank (32) to check that there is no water after the water is drained into the toilet bowl, and a user detection sensor (37) is installed on the front side of the toilet water tank (32) to detect a user entering a toilet. A hole is formed in the middle of a second pipe (33-2) connecting a water pressure control valve (41-1) and a piston (33-1) with each other, and a third pipe (33-3) connecting the second pump (38) and a second pipe (33-2) with each other is installed therein, and a backflow prevention valve (34) is installed in the third pipe (33-3) to prevent the backflow of water to the second pump (38). A water shutoff valve (41) is installed in a pipe connecting a water supply pipe (31) acid a water pressure control valve (41-1) With each other.

The second pump (38) is installed in the toilet water tank (32) and communicates with the second pipe (33-2) connecting the washing valve piston (33-1) and the water pressure control valve (41-1) with each other.

The third pipe (33-3) connects the toilet water tank (32) and the second pipe (33-2), and the upper end of the third pipe (33-3) is connected to the second pump (38) in the toilet water tank (32).

The backflow prevention valve (34) is installed between the second pipe (33-2) and the third pipe (33-3).

When the second water level sensor (35) checks that there is no water in the toilet water tank (32), the first pump (23) in the storage tank (20) turns on and the first solenoid valve (40) is opened to replenish water until the first water level sensor (36) detects the water at the full level, and when the water is full, the first pump (23) turns off and the first solenoid valve (40) is closed.

When the water in the toilet water tank (32) is full and the user enters the toilet, the user detection sensor (37) turns on the second pump (38), and when the user relieves himself and presses down a flushing handle (33) attached to the toilet bowl (30), the water in the toilet water tank (32) is discharged to the toilet bowl (30). When the second water level sensor (35) detects that there is no water in the toilet water tank after the water is discharged, the second pump (38) turns off and the first pump (23) turns on to replenish water until the first water level sensor (36) detects the water at the full level. Meanwhile, a drain pipe (57) is installed to prevent the used water from overflowing, over the toilet water tank (32) due to a malfunction of the first pump (23), and the upper portion of the drain pipe (57) is located at a slightly higher level than the first water level sensor (36) and the end of the drain pipe (57) is connected to a fourth pipe (39) provided for toilet water discharge such that the used water flowing into the toilet water tank (32) is stably recovered and stored, and the overflowing used water is rapidly and effectively discharged.

When a float ball of the water level sensor (21) placed at the bottom of the storage tank (20) checks that there is no water in the storage tank (20), the water shutoff valve (41) remains open all the time.

When the second water level sensor (35) checks that there is no water in the toilet water tank (32) and when the water level sensor (21) checks that there is no water in the storage tank (20), the user detection sensor (37) does not turn on the second pump (38) even when a user enters the toilet, Since the water shutoff valve (41) connected to the water is open according to the water level sensor (21), when the user relieves himself and presses down the flushing handle (33), water is supplied to the toilet bowl (30), while the backflow prevention valve (34) prevents the backflow to the toilet water tank (32) through the second pump (38).

Accordingly, the used water from the shower is effectively recovered and a sufficient amount of used water is stored in the storage tank (20) having a relatively huge internal space. In addition, when the amount of water stored in the storage tank (20) is insufficient for flushing several toilet bowls (30), a plurality of storage tanks (20) may be installed to reuse the used water for flushing the toilet bowls (30) thereby greatly reducing the amount of water used and contributing to economic savings and prevention of environmental pollution.

As illustrated in FIG. 1, the water collecting device of the present disclosure recovers the used water from the wash basin (50) provided in a bathroom or toilet: so that the recovered used water may be used for flushing the toilet bowl. An existing, sixth pipe (51) provided in the conventional wash basin (50) is connected to the water collecting tank (10) such that various types of water used for face or hand washing in the wash basin (50) may be recovered in the water collecting tank (10), and the used water may be transported from the water collecting tank (10) and stored in the storage tank (20).

A water tee (52) and a ball valve (53) are attached to the discharge pipe of the wash basin in case the used water from the wash basin is heavily contaminated such that the heavily contaminated used water is discharged to the outside through a sewage pipe (54) by opening the ball valve (53). A separate hole is provided at the bottom of the sink (55) such that contaminated used water from the sink (55) is discharged to the sewage pipe (54) as in the general cases, and the relatively clean used water is transported to the newly installed water collecting tank (10) through the sixth pipe (56) connected to the water collecting tank (10) and stored therein, while the original discharge pipe of the sink (55) is closed with the lid. Meanwhile, a strainer (12-1) is installed at the collecting port of the water collecting tank (10) lest a foreign substance like hair or solid organic matter flows front the wash basin or the sink into the water collecting tank (10) in the process of collecting the used water.

Therefore, various types of used water from the shower, wash basin, and kitchen may be effectively recovered and the recovered used water may be reused for flushing the toilet bowl (30), which is very economical and eco-friendly.

It is to be understood that the embodiments described herein and the configurations illustrated in the drawings as described above are only the most preferred embodiments of the present disclosure and do not represent all of the technical ideas of the present disclosure and that materials that may replace them are presented.

What is claimed is:

1. A water reuse device for reusing waste water discharged from a bathroom or a kitchen as toilet flushing water, comprising:

a water collecting tank (10) for collecting used water;

a storage tank (20) receiving the used water stored in the water collecting tank (10) and having a water level sensor (21);

a toilet water tank (32) located at a lower level than the storage tank (20) and having a first water level sensor (36) and a second water level sensor (35), wherein the first water level sensor (36) senses whether the reused water reaches a given full water level in the toilet water tank (32), wherein the second water level sensor (35) senses whether the reused water reaches a given depletion water level in the toilet water tank (32);

a first pipe (22) connecting, the storage tank (20) and the toilet water tank (32);

a first pump (23) provided in the storage tank (20) and supplying the used water in the storage tank (20) to the toilet water tank (32) through the first pipe (22);

a user detection sensor (37) sensing whether there is a user using a toilet howl (30);

a first solenoid valve (40) installed in the first pipe (22), wherein the first solenoid valve (40) turns on or shuts off the used water supplied from the storage tank (20) to the toilet water tank (32);

a second pump (38) installed in the toilet water tank (32) and communicating with a second pipe (33-2), wherein the second pipe (33-2) connects a washing valve piston (33-1) and a water pressure control valve (41-1) with each other;

a third pipe (33-3) connecting the toilet water tank (32) and the second pipe (33-2) with each other;

a backflow prevention valve (34) provided between the second pipe (33-2) and the third pipe (33-3); and a water shutoff valve (41) provided between a water supply pipe (31) and the water pressure control valve (41-1), wherein the water supply pipe (31) supplies water from a water supply pipe (11) to the toilet bowl (30) through the second pipe (33-2), wherein, when the second pump (38) turns on when (i) the toilet water tank (32) is in full, and (ii) the user detection sensor (37) senses the user using the toilet bowl (30), wherein the used water in the toilet water tank (32) is discharged to the toilet bowl (30) when a water flushing handle (33) is pressed, wherein, when the used water in the toilet water tank (32) detected by the second water level sensor (35) is at a first given depletion level, the second pump (38) turns off, and the first solenoid valve (40) is opened to turn on the first pump (23) and supply the used water from the storage tank (20) to the toilet water tank (32), wherein, when the used water in the toilet water tank (32) detected by the first water level sensor (36) is at a first given full level, the first pump (23) turns off, and the first solenoid valve (40) is shut off, wherein, when (a) the used water in the toilet water tank (32) is detected at the depletion level using the second water level sensor (35) and (b) water level in the storage tank (20) detected by the water level sensor (21) is at a second given depletion level, (i) the second pump (38) turns off even when the user detection sensor 37) detects the user who utilizes the toilet bowl (30), (ii) the water shutoff valve (41) remains opened, (iii) water supplied from outside through the water supply pipe (31) is discharged to the toilet bowl (30), and (iv) the backflow prevention valve (34) prevents the water supplied from outside from backflowing to the toilet water tank (32), wherein a drain pipe (57) is provided in the toilet water tank (32) and prevents the used water from overflowing over the toilet water tank (32) due to a malfunction of the first pump (23), wherein an upper end of the drain pipe (57) is located at a higher level than the first water level sensor (36), and wherein a lower end of the drain pipe (57) is connected to a fourth pipe (39) and discharges the used water overflowing from the toilet water tank (32) to the toilet bowl (32), wherein the fourth pipe (39) is provided between the piston (33-1) and the toilet bowl (30).

* * * * *